US007637779B2

(12) United States Patent
Nagata et al.

(10) Patent No.: US 7,637,779 B2
(45) Date of Patent: Dec. 29, 2009

(54) CONNECTOR

(75) Inventors: Takayuki Nagata, Yao (JP); Hayato Kondo, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 12/007,422

(22) Filed: Jan. 10, 2008

(65) Prior Publication Data

US 2008/0188132 A1 Aug. 7, 2008

(30) Foreign Application Priority Data

Jan. 29, 2007 (JP) ..... 2007-017794

(51) Int. Cl.
*H01R 9/03* (2006.01)

(52) U.S. Cl. ..... 439/607.49; 439/607.51; 439/497; 439/579

(58) Field of Classification Search .....
439/607.41–607.52, 579, 497
See application file for complete search history.

(56) References Cited

U.S. PATENT DOCUMENTS

| | | | | |
|---|---|---|---|---|
| 6,305,978 | B1 * | 10/2001 | Ko et al. | 439/579 |
| 6,619,985 | B1 * | 9/2003 | Ko | 439/607 |
| 2006/0228952 | A1 * | 10/2006 | Feldman et al. | 439/835 |

FOREIGN PATENT DOCUMENTS

JP 2006-54102 2/2006

* cited by examiner

*Primary Examiner*—Ross N Gushi
(74) *Attorney, Agent, or Firm*—Kratz, Quintos & Hanson, LLP

(57) ABSTRACT

A connector includes an elongated body having a plurality of contacts arranged in spaced relation along a length thereof and a shield member for shielding the body. The shield member includes a first shield portion for shielding first thicknesswise end of the body and a second shield portion for shielding a second thicknesswise end of the body. At least one of the first and second shield portions is partly or entirely embedded in the body.

9 Claims, 8 Drawing Sheets

(a)

(b)

CONNECTOR

The present application claims priority under 35 U.S.C. §119 of Japanese Patent Application No. 2007-017,794 filed on Jan. 29, 2007, the disclosure of which is expressly incorporated by reference herein in its entity.

BACKGROUND OF THE ART

1. Field of the Invention

The present invention relates to a connector having a plurality of contacts arranged in spaced relation along a length thereof. More particularly, the present invention relates to a plug connector including a plurality of cables connected to the corresponding contacts.

2. Description of the Related Art

For this type of plug connector, there is one that includes an elongated body having a plurality of contacts arranged in spaced relation along a length thereof; a shield cover to be attached to a topside of the body; and a shield member to be attached to an underside of the body and to be electrically connected to the shield cover (see Japanese Patent Application Laid-Open No. 2006-54102).

Such plug connector is in need of slimming down along with slimming down of a receptacle connector to be mounted on an electronic device such as a flat panel display for a liquid crystal television.

SUMMARY OF THE INVENTION

However, if the body is simply slimmed down, the strength of the body decreases. Particularly, when a shield member and a shield cover are attached to the topside and underside of a body to address electromagnetic interference (EMI) as in the above conventional art example, if the body is slimmed down taking into account of the thicknesses of the shield member and the shield cover, the strength of the body significantly decreases. That is, it is very difficult for the above-described connector to satisfy both of suitable shield characteristics as EMI measures and the slim body.

The present invention is made in view of the above-described circumstances and an object of the present invention is therefore to provide a connector having suitable shield characteristics and a slimmed-down body.

To solve the above-described problem, a connector of the present invention includes an elongated body having a plurality of contacts arranged in spaced relation along a length thereof; and a shield member for shielding the body, wherein the shield member includes a first shield portion for shielding first thicknesswise end of the body; and a second shield portion for shielding a second thicknesswise end of the body, and at least one of the first and second shield portions is partly or entirely embedded in the body.

By thus embedding at least one of the first and second shield portions partly or entirely in the body, the strength of the body can be improved. Moreover, since both thicknesswise end portions of the body are shielded by the first and second shield portions, suitable shield characteristics can be obtained. When embedding at least one of the first and second shield portions partly or entirely in the body, it is possible to adjust the distance between portions of the first and second shield portions that are embedded in the body and the contacts, making it possible to control impedances.

If the connector is a plug connector that is connectable to a receptacle connector, the connector may further include a plurality of cables connected to the corresponding contacts. The contacts each may include a contact end which is exposed from a first thicknesswise end face of a widthwise distal end portion of the body and which is contactable to a contact of the receptacle connector; and a connection end which is exposed from a first thicknesswise end face of a middle widthwise portion of the body and to which a corresponding one of the cables is connected. The shield member may further include a third shield portion that connects between the first shield portion and the second shield portion, and the second shield portion has a ground connection portion that is disposed along the contact ends and is connectable to a ground portion of the receptacle connector.

The second shield portion may be embedded in the second thicknesswise end portion of the body such that the ground connection portion thereof is exposed from a second thicknesswise end face of the distal end of the body.

Because the second shield portion is provided with the ground connection portion, the ground connection portion can be brought into contact with the ground portion of the receptacle connector concurrently when the contact ends of the contacts are brought into contact with the corresponding contacts of the receptacle connector. That is, simultaneous electrical connections may be established between the contacts of the connector of the present invention and the contacts of the mating receptacle connector and between the shield member of the connector of the invention and the ground portion of the receptacle connector. Accordingly, the connector of the present invention can be easily connected to the receptacle connector.

If the cables each include a signal line; an insulator covering the signal line; and a shield conductor provided on a peripheral surface of the insulator, the first shield portion may shield a widthwise rear end of the body and the first shield portion may be in contact with the shield conductors of the cables in a state that the signal lines of the cables are connected to the corresponding connection ends of the contacts.

In this case, when the signal lines of the cables are connected to the corresponding connection ends of the contacts, the shield conductors of the cables come into contact for electrical connection with the first shield portion. Thus, the cables can be easily connected to the connector and the shield characteristics of the connector can be improved.

If the body includes a thick portion; and a thin portion which is provided to the thick portion and which is fittable into the receptacle connector, the thin portion is provided with the contact ends and the thick portion is provided with the connection ends. The shield member may further include a fourth shield portion which continues to the first shield portion and which is embedded in the thick portion so as to be oriented along the connection ends. A distance between the fourth shield portion and the connection ends may be substantially the same as a distance between the ground connection portion of the second shield portion and the contact ends.

Such configuration helps to match the impedance between the fourth shield portion and the connection ends provided in the thick portion with the impedance between the ground connection portion of the second shield portion and the contact ends provided in the thin portion.

The connector may further include a shield cover which is attached to the body with the cables being sandwiched between the shield cover and the body and which covers the first thicknesswise end face of the body. In this case, lengthwise opposite end portions of the body are provided with a pair of attachment holes for attaching the shield cover therethrough, lengthwise opposite end portions of the second shield portion are provided with at least a pair of connection pieces, the connection pieces are respectively insertable into the pair of attachment holes from a second thicknesswise end side, and lengthwise opposite end portions of the shield cover are provided with at least a pair of connection arms, the connection arms being respectively insertable into the pair of attachment holes from a first thicknesswise end side and respectively coming into contact with the pair of connection pieces.

That is, by inserting the pair of connection arms of the shield cover into the pair of attachment holes the body, the pair of connection arms comes into contact and electrical connection with the pair of connection pieces of the second shield portion. Hence, electrical connection can be easily established between the shield cover and the second shield portion, simultaneously shielding both thicknesswise ends of the connector. Accordingly, the shield characteristics of the connector can be improved.

One pair of the pair of the connection pieces and the pair the connection arms may serve as means for locking the other pair, or alternatively, both pairs may serve as means for locking each other pair. Such configuration eases electrical connection between the shield cover and the second shield portion and attachment of the shield cover to the body.

In the connector of the present invention, the strength of the body can be improved because at least one of the first and second shield portions is partly or entirely embedded in the body. Moreover, the connector, with the both thicknesswise ends of the body shielded by the first and second shield portions, can obtain suitable shield characteristics while contributing to a slimmed-down apparatus.

In addition, upon embedding part or all of at least one of the first and second shield portions in the body, the distance between the embedded portion and the contacts can be adjusted, making it possible to control impedances. Accordingly, the transmission characteristics of the connector can be improved, and as a result, the connector can be used for high-speed digital signal transmission.

BRIEF DESCRIPTION OF THE DRAWINGS

FIG. 2A is a schematic plan view; and FIG. 2B is a schematic bottom view;

FIG. 4A is a view showing a state in which a cable cover is not placed; and FIG. 4B is a view showing a state in which the cable cover is placed;

DESCRIPTION OF THE PREFERRED EMBODIMENTS

A connector according to an embodiment of the present invention will be described below with reference to the drawings.

Figure 1:
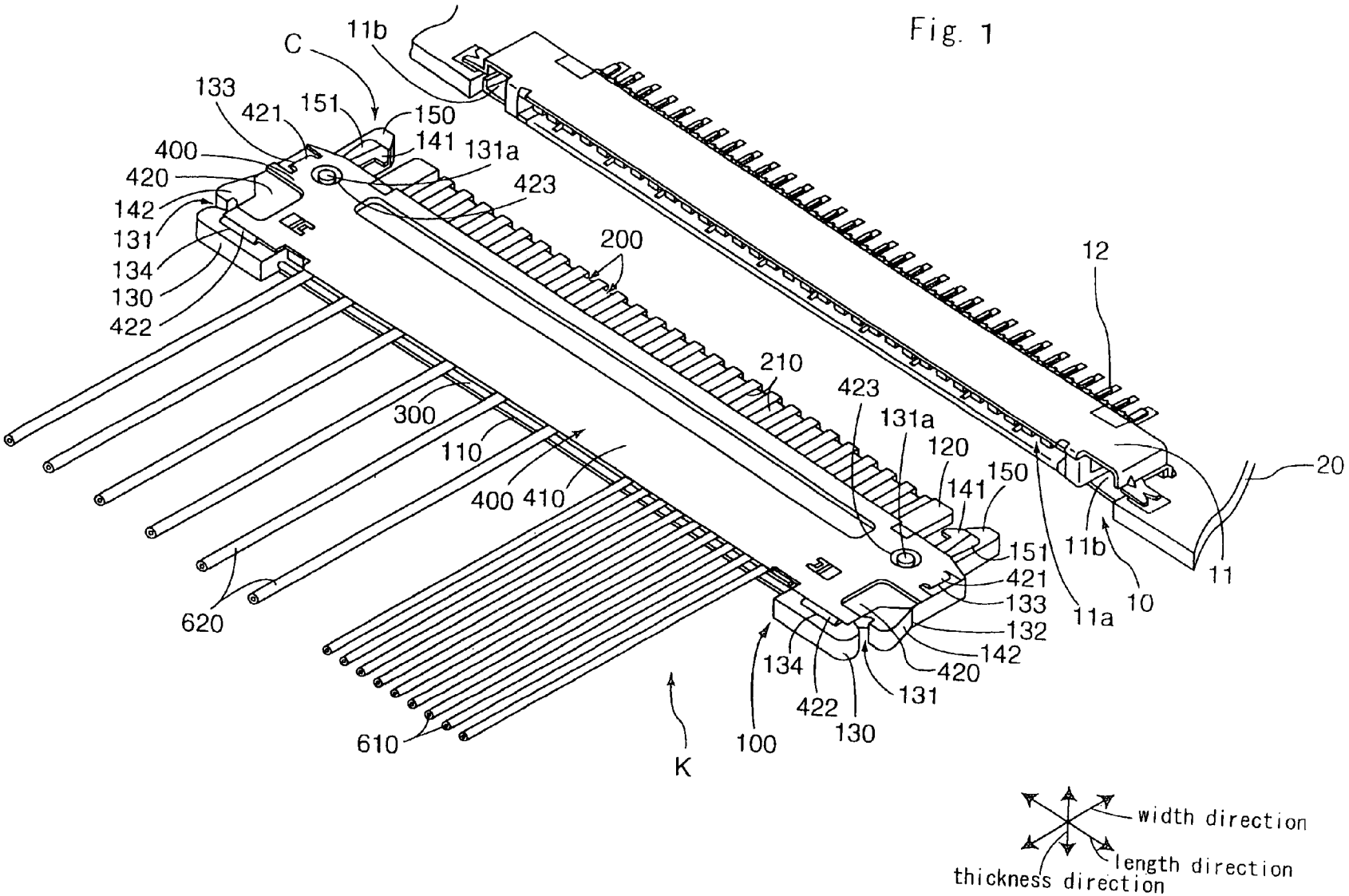
FIG. 1 is a schematic perspective view showing a state before a connector according to an embodiment of the present invention is connected to a receptacle connector.
Figure 2:
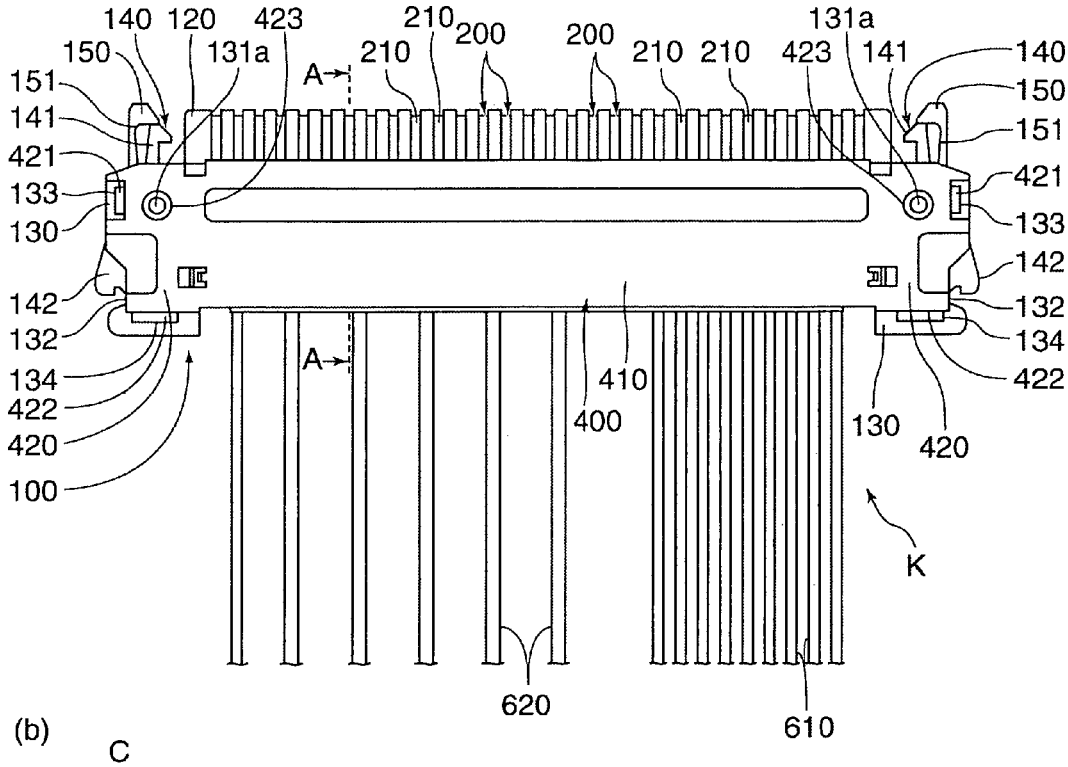
FIGS. 2A and 2B are views showing the connector.
Figure 2:
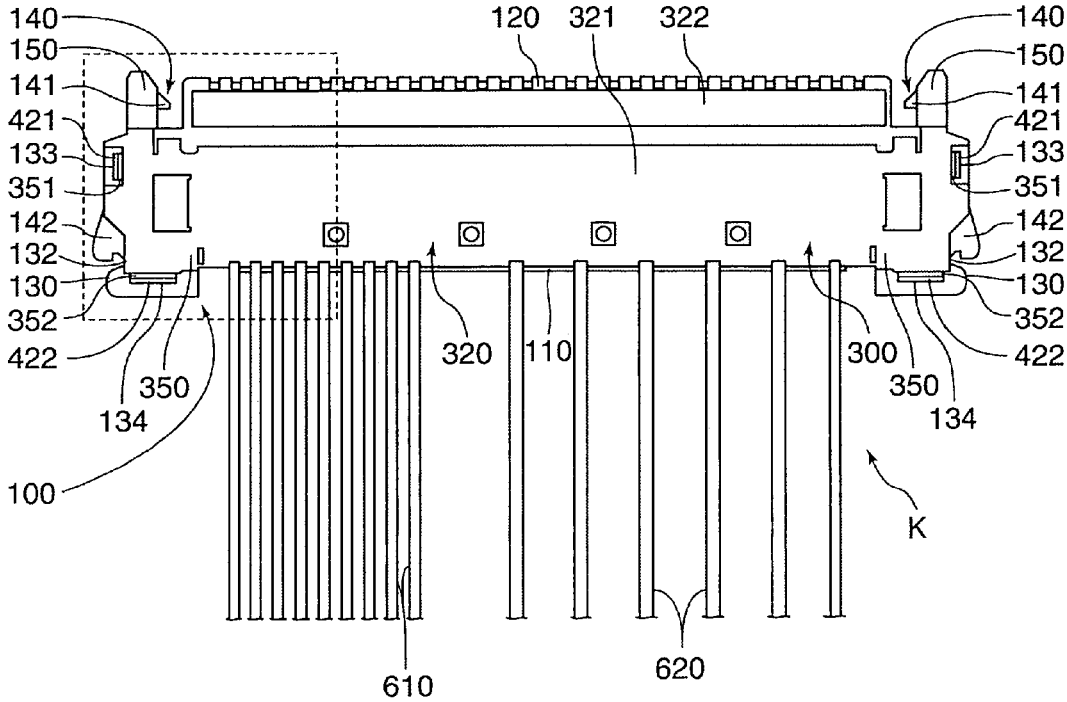

A connector C shown in FIGS. 1, 2A and 2B is a plug connector which is connectable to a receptacle connector 10. The connector C includes an elongated body 100; a plurality of contacts 200 arranged in a spaced relation along a length of the body 100; a cable assembly K to be connected to the contacts 200; a shield member 300 for shielding the body 100; and a shield cover 400 to be attached to a top face (i.e., first thicknesswise end face) of the body 100. A detailed description will be made below.

As shown in FIG. 1, the receptacle connector 10 has a elongated main body portion 11 having an opening portion 11*a* and provided on a circuit board 20 of an electronic device which is not shown; a plurality of contacts 12 arranged on the main body portion 11 in a length direction thereof with a predetermined space provided therebetween; and a ground portion (not shown) provided inside the opening portion 11*a* of the main body portion 11.

The main body portion 11 has a pair of engaging recesses 11*b* provided on opposite sides of the opening portion 11*a*. First lengthwise ends of the contacts 12 appear inside the opening portion 11*a* of the main body portion 11 while second lengthwise ends of the contacts 12 are connected to the circuit board 20.

The body 100 is molded of insulation resin. As shown in FIGS. 1 to 5 the body 100 has a substantially rectangular thick portion 110; a thin portion 120 provided at a distal widthwise end side of the thick portion 110; a pair of overhang portions 130 provided at opposite lengthwise ends of the thick portion 110; a pair of locking means 140 attached to the pair of overhang portions 130 and jutting out toward the widthwise distal end side; and a pair of protective arms 150 provided toward outer ends of widthwise distal end faces of the pair of overhang portions 130 and protecting the pair of locking means 140.

Figure 3:
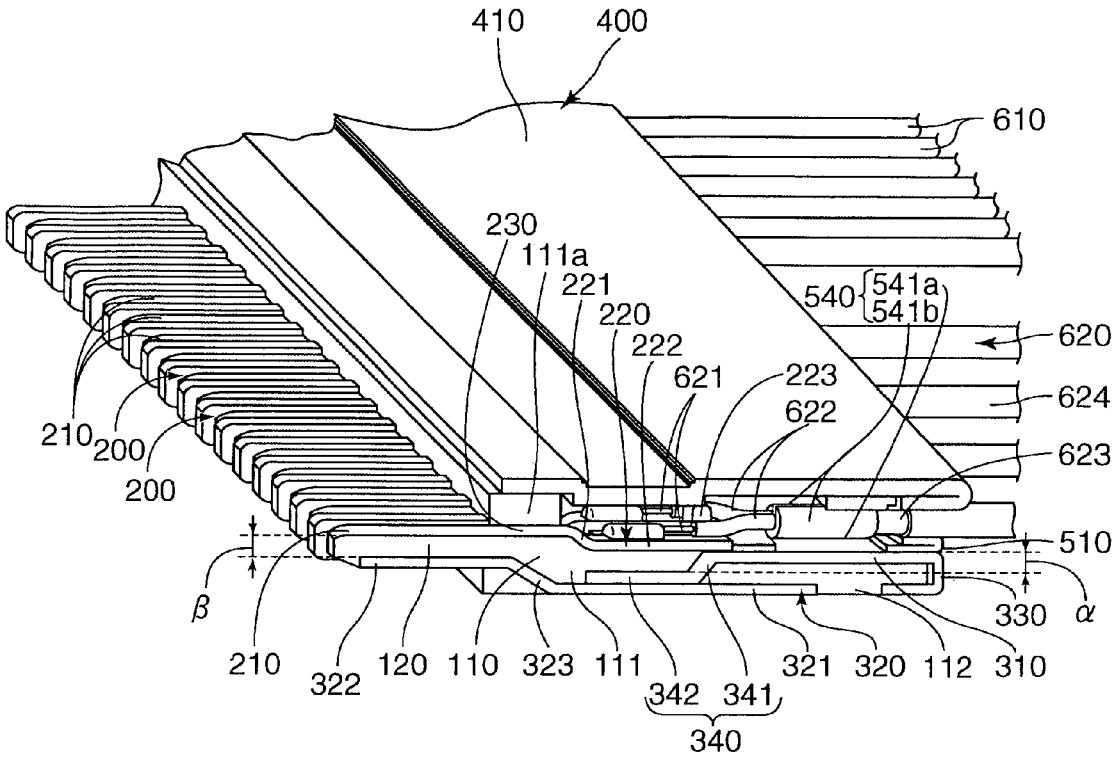
FIG. 3 is a cross-sectional perspective view of the connector taken along line A-A in FIG. 2.
Figure 4:
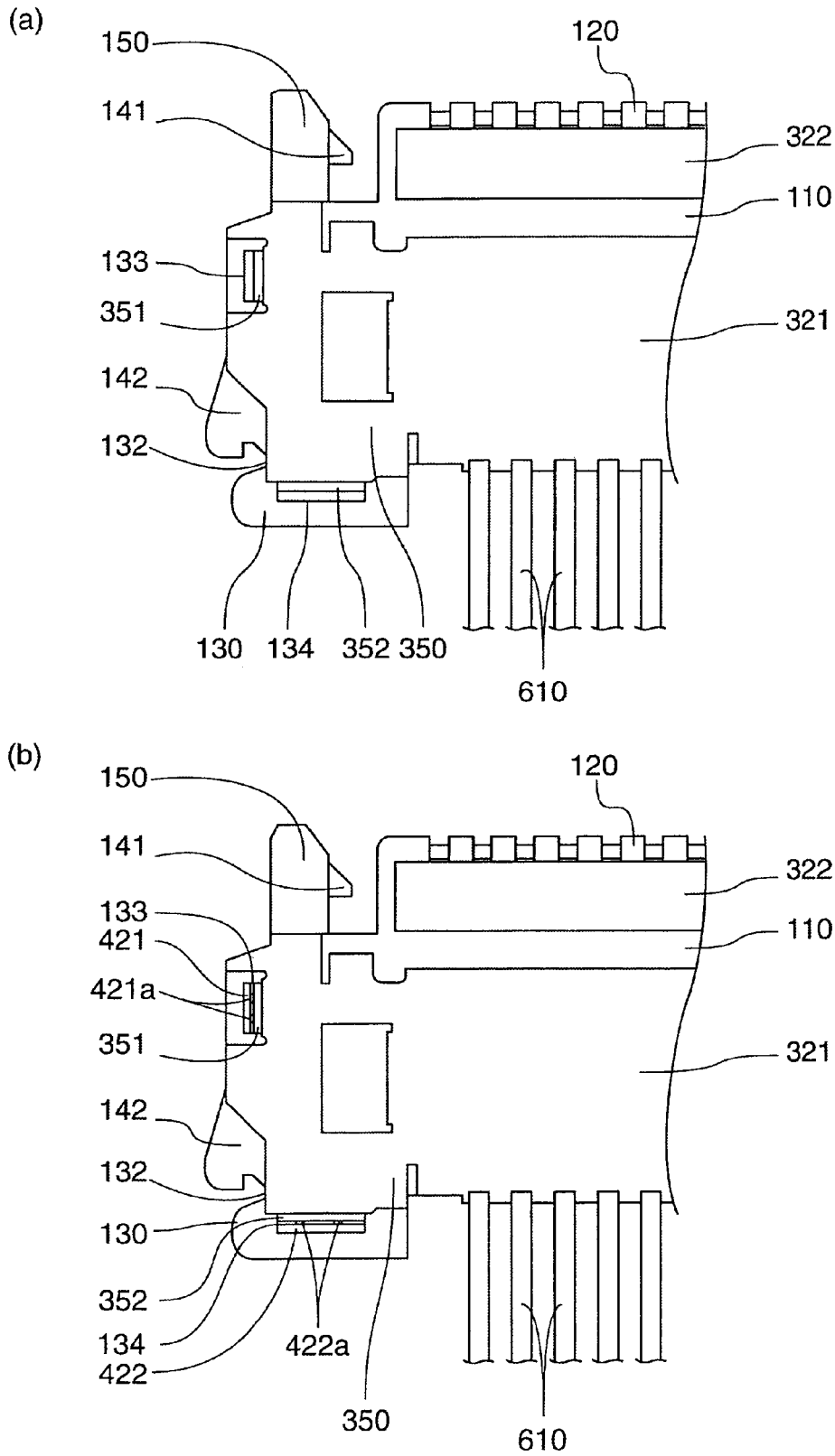
FIGS. 4A and 4B are enlarged bottom views of an end portion of the connector in FIG. 2.

As shown in FIG. 3, the thick portion 110 has a widthwise distal end portion 111 and a widthwise rear end portion 112. The rear end portion 112 corresponds to a widthwise rear end portion of the body 100.

Figure 5:
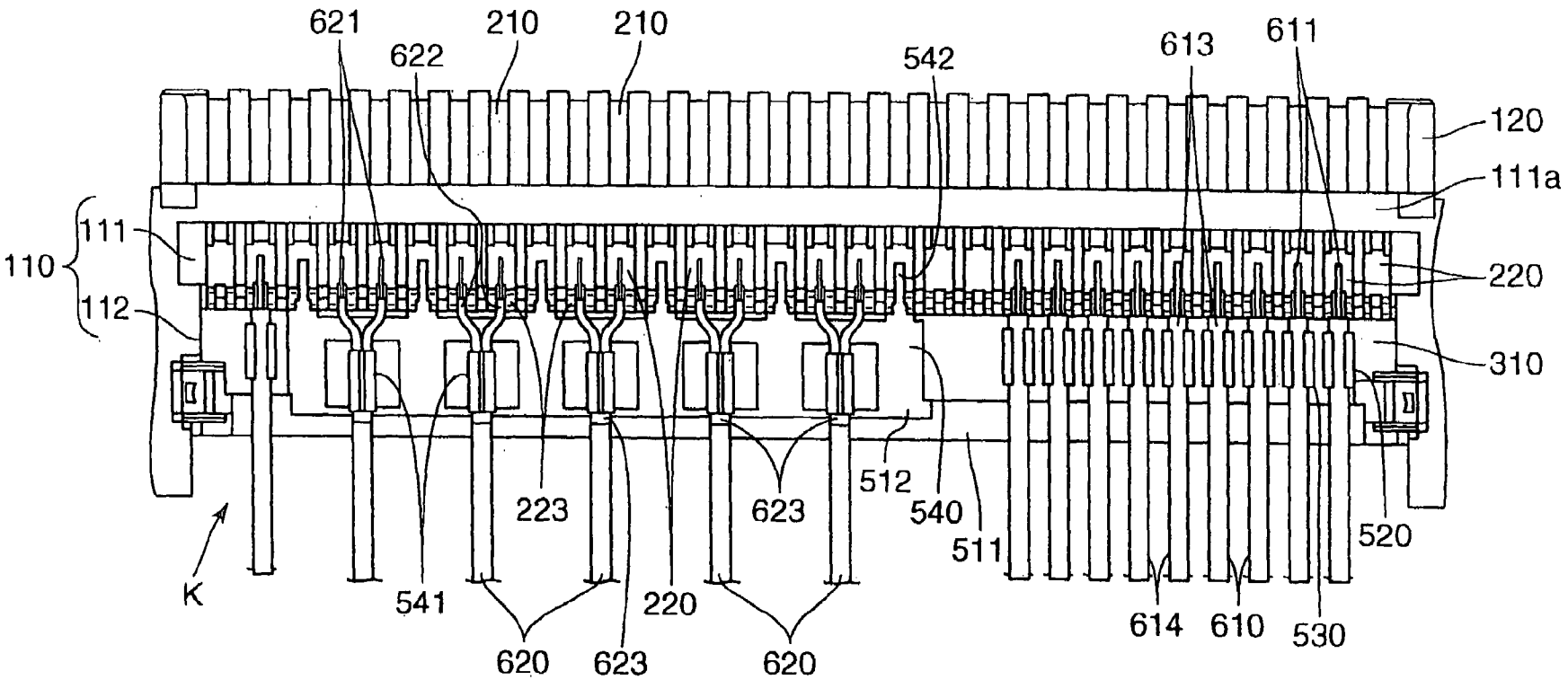
FIG. 5 is a schematic plan view of a central portion of the connector showing a state in which the cable cover is not placed.

The distal end portion 111 corresponds to a widthwise middle portion of the body 100. On a topside (i.e., first thicknesswise end side) of the distal end portion 111, as shown in FIGS. 3 and 5, a projection vein 111*a* that secures the plurality of contacts 200 is provided along a length direction.

The thin portion 120 is a substantially rectangular part that is thinner than the thick portion 110. The thin portion 120 corresponds to a widthwise distal end portion of the body 100.

As shown in FIGS. 1, 2A, 2B, 4A, and 4B, the overhang portions 130 each are a substantially rectangular part that overhangs further rearward than the rear end portion 112 of the thick portion 110 and have a substantially rectangular recess 131 opening upward. The bottom of each recess 131 has a cylindrical turning shaft portion 131*a*, which is located inside a first attachment hole 133 which will be described later.

Each overhang portion 130 has a first open portion not shown at the inner side of a widthwise distal end, whereby each recess 131 communicates with a notch portion 151 of the protective arm 150. Each overhang portion 130 also has a second open portion 132 at a rear end of an outer end in said length direction.

Furthermore, each overhang portion 130 has the first attachment hole 133 for attaching the shield cover 400 on a topside of the distal outer end thereof. In addition, a second attachment hole 134 for attaching the shield cover 400 is provided on a topside of the widthwise rear end of each overhang portion 130.

As shown in FIGS. 1, 2A, 2B, 4A, and 4B, the are substantially rectangular parts. At the inner side of each protective arm 150, there is provided with the notch portion 151 for accommodating an engaging hook 141 of the locking means 140.

The locking means 140 each have the engaging hook 141 for engagement with the engaging recess 11*b* of the receptacle connector 10; and an operating portion 142 which is a substantially triangular member in plan view for operating the engaging hook 141.

Each operating portion 142 is pivotally supported at its first apex portion by the turning shaft portion 131*a* of the overhang portion 130 and is accommodated in the recess 131 of the overhang portion 130. Each operating portion 142 is urged at a side between the first apex portion and a second apex portion (not shown) by an urging means (not shown). This urging force urges a third apex portion of each operating portion 142 to operably jutting out of the second open portion 132 of the overhang portion 130.

The engaging hooks 141 each are a rod-like body having a hook portion provided at its tip end. In each engaging hook 141, its base end is provided at the first apex portion of the operating portion 142 and its tip end is accommodated in the notch portion 151 of the protective arm 150 such that the tip end can enter and come out of the notch portion 151.

That is, the hook portion of each engaging hook 141 usually juts out of the notch portion 151 of the protective arm 150 by the operating portion 142 being urged by the urging means and the operating portion 142 and the engaging hook 141 being thereby turned. When the third apex portion of the operating portion 142 is operated to turn the operating portion 142 and the engaging hook 141 against the urging means, the hook portion of each engaging hook 141 is accommodated in the notch portion 151 of the protective arm 150.

The contacts 200 are embedded in upper ends of the distal end portion 111 of the thick portion 110 and the thin portion 120 of the body 100 and are secured to the projection vein 111*a* of the thick portion 110.

As shown in FIGS. 3 and 5, the contacts 200 each have a contact end 210 exposed from a topside of the thin portion 120; a connection end 220 exposed from a topside of the distal end portion 111 of the thick portion 110; and a secured portion 230 connecting between the contact end 210 and the connection end 220 and secured to the projection vein 111*a*.

The connection ends 220 each have a bent portion 221 which continues to the secured portion 230 and is bent downward; a connection end main body 222 which continues to the bent portion 221; and a guide portion 223 which continues to the connection end main body 222 and which guides a signal line 611 or 621 of a first or second cable 610 or 620 in the cable assembly K.

The guide portions 223 each are formed by cutting out a central portion of a rear end of the connection end main body 222 and bending both ends thereof upward. The signal line 611 or 621 of the first or second cable 610 or 620 is inserted and guided between the both ends.

The shield member 300 is a conductive plate-like body. As shown in FIGS. 2A and 2B to 5, the shield member 300 has a first shield portion 310 embedded in an upper end (i.e., first thicknesswise end) of the rear end portion 112 of the thick portion 110; a second shield portion 320 embedded in lower ends (i.e., the second thicknesswise end) of the thick portion 110 and the thin portion 120; a third shield portion 330 having a substantially lateral U-shape in cross section and connecting a base end of the first shield portion 310 to a base end of the second shield portion 320; a fourth shield portion 340 which continues to a distal end of the first shield portion 310 and which is embedded in the distal end portion 111 of the thick portion 110; and a pair of fifth shield portions 350 which are provided at lengthwise opposite ends of a bottom plate portion 321 of the second shield portion 320 and which are embedded in corresponding lower ends of the overhang portions 130.

As shown in FIGS. 2B, 3, 4A, and 4B, the second shield portion 320 has the substantially rectangular bottom plate portion 321, which forms a part of the lower end of the thick portion 110; a substantially rectangular ground connection portion 322, which forms a part of the lower end of the thin portion 120 and which is smaller than the bottom plate portion 321; and a slope portion 323 connecting between the bottom plate portion 321 and the ground connection portion 322.

An undersurface of the bottom plate portion 321 is flush with an undersurface of the thick portion 110. That is, the undersurface of the bottom plate portion 321 is exposed from the underside of the thick portion 110.

The ground connection portion 322 extends along and parallel to all the contact ends 210 of the contacts 200 and an undersurface of the ground connection portion 322 is flush with an undersurface of the thin portion 120. Therefore, the undersurface of the ground connection portion 322 is exposed from the underside of the thin portion 120 and is contactable with the ground portion of the receptacle connector 10.

The slope portion 323 is a part bent obliquely downward from the ground connection portion 322 and sloped and is embedded in the distal end portion 111 of the thick portion 110.

As shown in FIGS. 2B, 4A, and 4B, the fifth shield portions 350 each are a substantially rectangular frame-like body. Each fifth shield portion 350A is provided with a first connection piece 351 at a distal end of an outer lengthwise end thereof and with a second connection piece 352 at a widthwise rear end.

The first connection pieces 351 are plate bodies that are bent at the right angle to the fifth shield portions 350. The first connection pieces 351 are inserted into corresponding inner portions of the first attachment holes 133 of the overhang portions 130 from the bottom (from the second thicknesswise end side).

The second connection pieces 352 are also plate bodies that are bent at the right angle out of the fifth shield portion 350. The second connection pieces 352 are inserted into corresponding inner portions of the second attachment holes 134 of the overhang portions 130 from the bottom (from the second thicknesswise end side).

A top surface of the first shield portion 310 is flush with a top surface of the rear end portion 112 of the thin portion 120. That is, the top surface of the first shield portion 310 is exposed from the topside of the rear end portion 112 of the thin portion 120 and is contactable with a cable attachment 500 of the cable assembly K.

The fourth shield portion 340 has a angled portion 341 which continues to the first shield portion 310 and which is bent downward; and an extended portion 342 which continues to the angled portion 341 and which is arranged along and parallel to all the connection end main bodies 222 of contacts 200.

The angled portion 341 is angled in such a manner that a distance $\alpha$ between the extended portion 342 of the fourth shield portion 340 and the connection end main bodies 222 of the connection ends 220 of the contacts 200 is the same as a distance $\beta$ between the ground connection portion 322 of the second shield portion 320 and the contact ends 210 of the contacts 200.

By thus conforming the distance α to the distance β, the impedance between the extended portion 342 of the fourth shield portion 340 and the connection end main bodies 222 of the connection ends 220 of the contacts 200 provided in the thick portion 110 is made to match the impedance between the ground connection portion 322 of the second shield portion 320 and the contact ends 210 of the contacts 200 provided in the thin portion 120.

As shown in FIGS. 1, 2A, and 3, the shield cover 400 is a conductive plate-like body having a substantially rectangular cover main body 410 and a pair of engaging portions 420 provided at lengthwise opposite ends of the cover main body 410.

The cover main body 410 covers the topside of the thick portion 110 of the body 100 with the first and second cables 610 and 620 of the cable assembly K being sandwiched between the cover main body 410 and the thick portion 110.

The engaging portions 420 each are a substantially rectangular part which continues to the cover main body 410. Each engaging portion 420 has a first connection arm 421 provided at a distal end of an lengthwise outer end thereof and a second connection arm 422 provided at a widthwise rear end thereof.

As shown in FIGS. 2A, 2B, and 4B, the first connection arms 421 each are a plate body that is bent at the right angle to the engaging portion 420, and each have two first locking projections 421*a* provided on an inner side thereof. The sum of the thickness size of the first connection arm 421 and the height size of the first locking projection 421*a* is slightly greater than the size between the first attachment hole 133 of the overhang portion 130 and the first connection piece 351 of the shield member 300 (that is, the width of an outer portion of the first attachment hole 133).

Similarly, as shown in FIGS. 2A, 2B, and 4B, the second connection arms 422 each are also a plate body that is bent at the right angle to the engaging portion 420, and each have two second locking projections 422*a* provided on an inner side thereof. The sum of the thickness of the second connection arm 422 and the height of the second locking projection 422*a* is slightly greater than the distance between the second attachment hole 134 of the overhang portion 130 and the second connection piece 352 of the shield member 300 (that is, the width of an outer portion of the second attachment hole 134).

Hence, when the first and second connection arms 421 and 422 are inserted into the corresponding outer portions of the first and second attachment holes 133 and 134 of the overhang portions 130 from above (from the first thicknesswise end side), the first and second locking projections 421*a* and 422*a* respectively abut the first and second connection pieces 351 and 352 of the shield member 300. With this structure, the shield cover 400 is locked into the body 100, preventing detachment of the shield cover 400 from the body 100.

As shown in FIGS. 1 and 2A, at an position inside the first connection arm 421 of each engaging portion 420, there is provided with a securing hole portion 423 for receiving the turning shaft portion 131*a* of the overhang portion 130.

Figure 6:
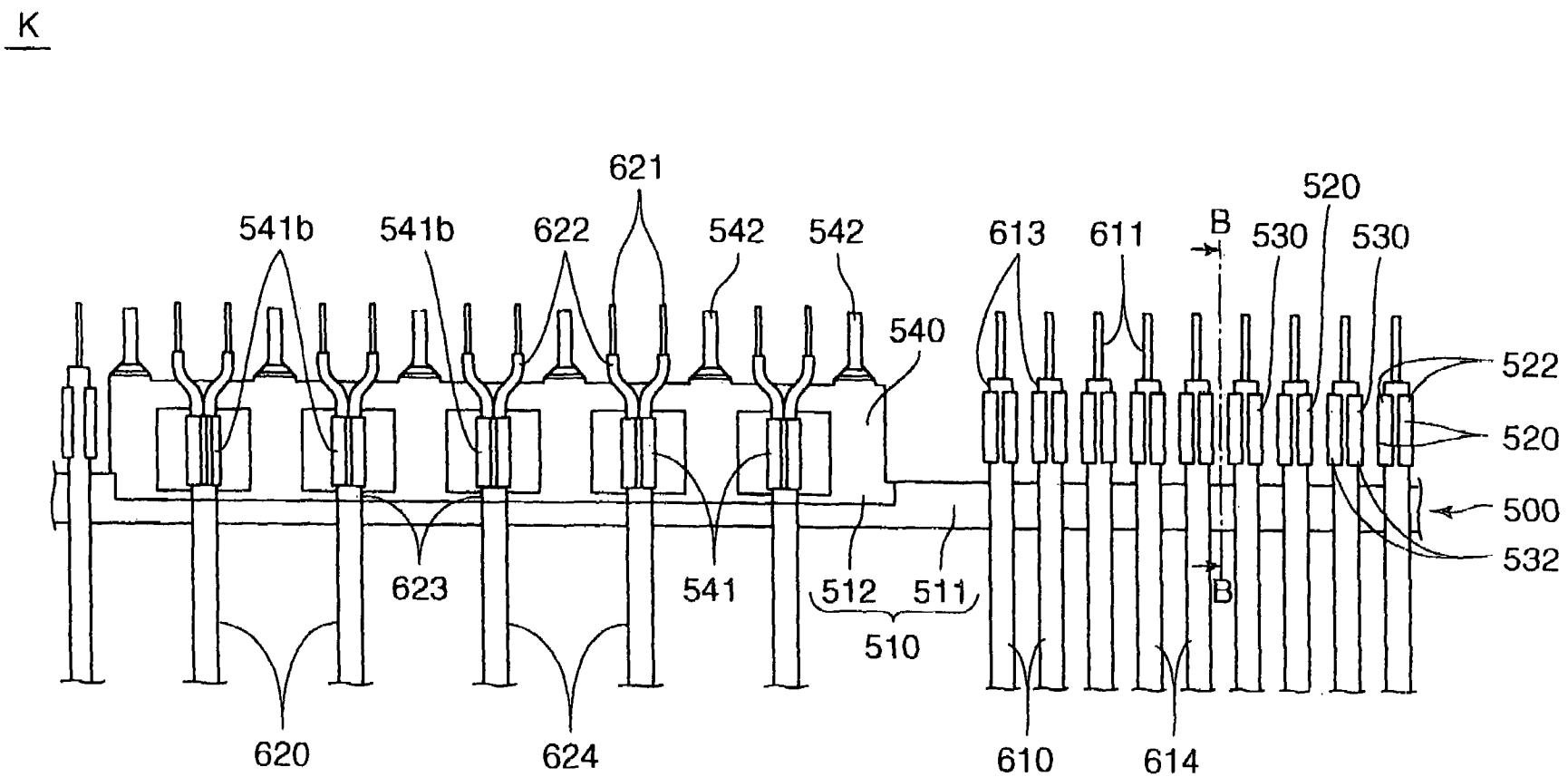
FIG. 6 is a schematic plan view of a cable assembly of the connector.
Figure 7:
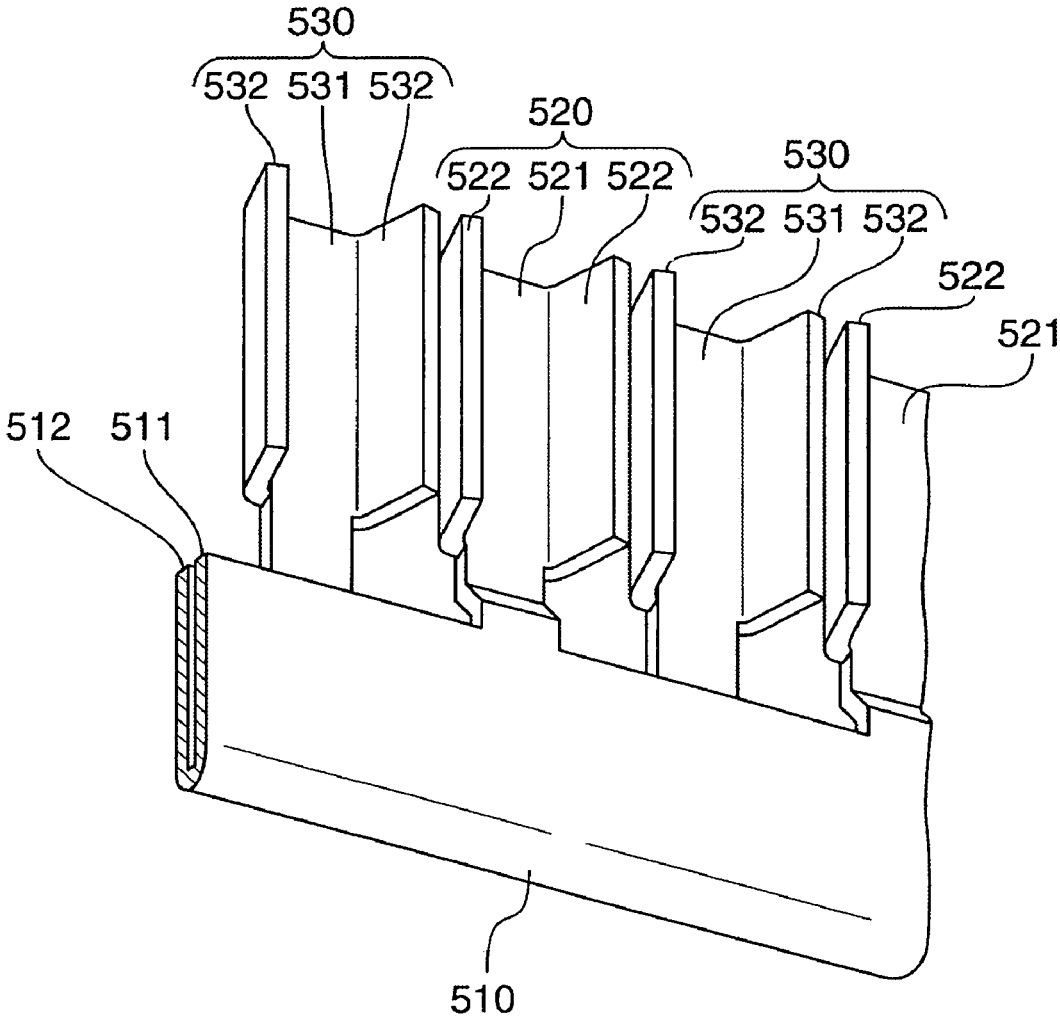
FIG. 7 is a cross-sectional perspective view of some cable holding portions of the cable assembly taken along line B-B shown in FIG. 6.

As shown in FIGS. 6 and 7, the cable assembly K includes the cable attachment 500 and a plurality of first and second cables 610 and 620 which are attached to the cable attachment 500 so as to be arranged parallel to one another. Each of these elements will be described in detail below.

The cable attachment 500 includes a base portion 510; a plurality of first attachment portions 520 arranged at a first end portion 511 of the base portion 510 in a length direction thereof with a space provided therebetween; a plurality of second attachment portions 530 arranged in a spaced relation along a length of an second end portion 512 of the base portion 510; and an extended portion 540 provided at the second end portion 512 of the base portion 510.

As shown in FIG. 7, the base portion 510 is an elongated plate body having conductivity and being bent into a substantially U-shape such that the first end portion 511 and the second end portion 512 in a width direction are oriented in the same direction. A tip end of the first end portion 511 of the base portion 510 facing the extended portion 540 is cut out in a rectangular shape.

The first attachment portions 520 and the second attachment portions 530 are alternately disposed in the length direction. The space between any first attachment portion 520 and the adjacent second attachment portion 530 is set to be three times or less than the outer diameter of the first cable 610, while the space between any two adjacent first attachment portions 520 and the space between any two adjacent second attachment portions 530 are greater than the space between any first attachment portion 520 and the adjacent second attachment portion 530.

In other words, the first and second attachment portions 520 and 530 can be disposed with narrow pitch spacing which is less than three times the outer diameter of the first cables 610, while it is possible to widen the space between the first attachment portions 520 and the space between the second attachment portions 530. Consequently, when the first and second attachment portions 520 and 530 are formed by cutting and raising from the tip end of the first end portion 511 and the tip end of the second end portion 512 of the base portion 510, it is possible to sufficiently take developed lengths of the first and second attachment portions 520 and 530 required to suitably hold the first cables 610.

As shown in FIGS. 6 and 7, the first attachment portions 520 each are a part having a substantially U-shape in cross section, and have a first support portion 521 which continues to the first end portion 511 of the base portion 510; and a pair of first sandwiching portions 522 provided at opposite ends of the first support portion 521 so as to be oriented in a direction intersecting the length direction.

As shown in FIGS. 6 and 7, the second attachment portions 530 each are also a part having a substantially U-shape in cross section, and have a second support portion 531 which continues to the second end portion 512 of the base portion 510; and a pair of second sandwiching portions 532 provided at opposite ends of the second support portion 531 so as to be oriented in a direction intersecting the length direction.

The first support portions 521 are plate-like bodies to place the corresponding first cables 610 thereon. As shown in FIG. 7, base ends of the first support portions 521 are bent and top faces (cable placing sides) of tip ends of the first support portions 521 are level with top faces (cable placing side) of the second support portion 531. The second support portions 531 are straight plate-like bodies to place the first cable 610 thereon.

Figure 8:
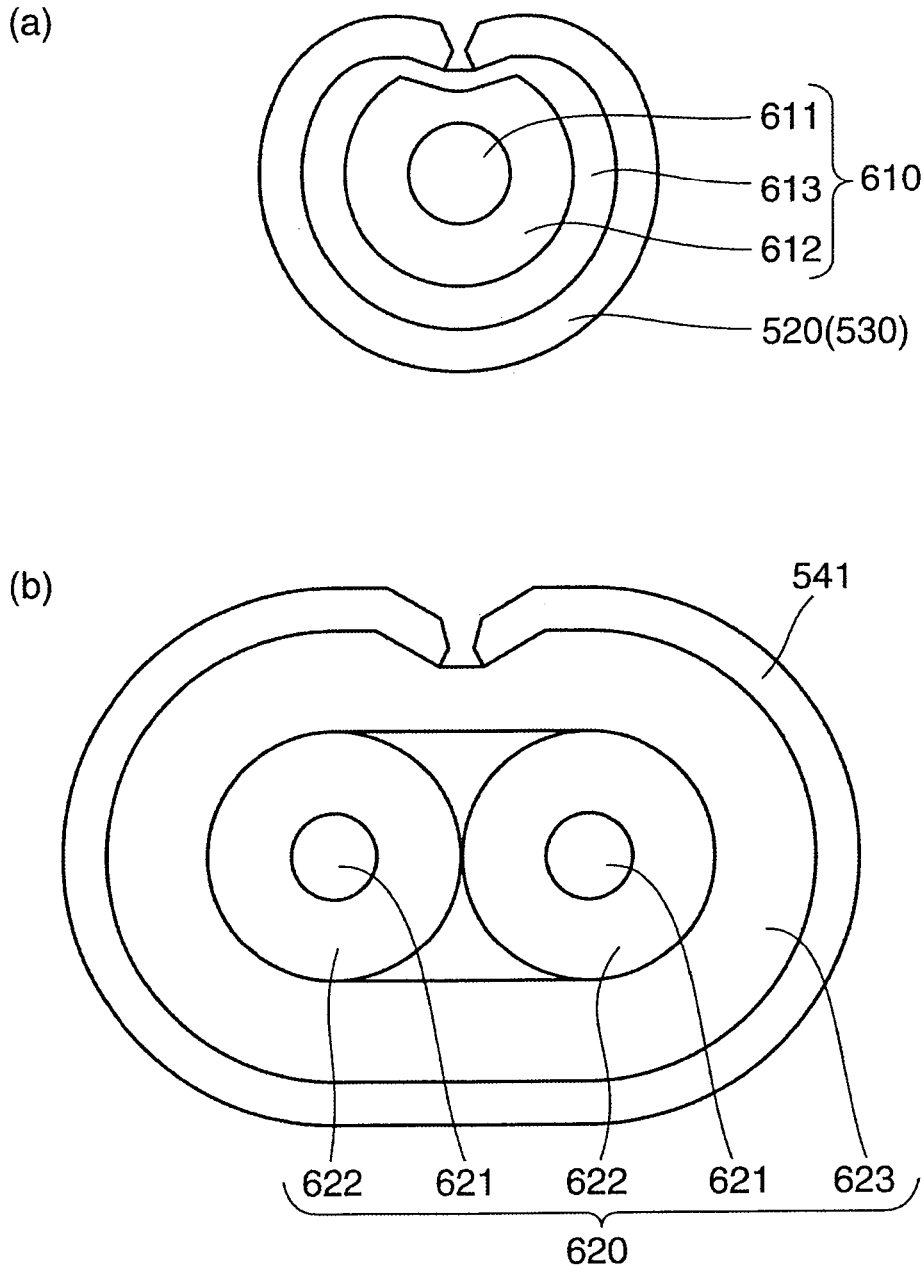
FIG. 8A is a schematic cross-sectional view of a first cable in the cable assembly.
FIG. 8B is a schematic cross-sectional view of a second cable in the cable assembly.

As shown in FIG. 8A, pairs of first sandwiching portions 522 are to be swaged to sandwich the corresponding first cables 610 placed on the first support portions 521. The pairs of second sandwiching portions 532 are of the same type as the pairs of first sandwiching portions 522.

The sum of the width of the first support portion 521 and the widths of the pair of first sandwiching portions 522 is substantially the same as the length of an outer periphery of the first cable 610. With this, as shown in FIG. 8A, the first and second attachment portions 520 and 530 each can cover substantially the entire outer periphery of the corresponding first cable 610. Similarly, the sum of the width of the second support portion 531 and the widths of the pair of second sandwiching portions 532 is also substantially the same as the length of an outer periphery of the corresponding first cable 610.

As shown in FIGS. 5 and 6, the extended portion 540 is a substantially rectangular plate body extended from the second end portion 512 of the base portion 510. Along a length of a central portion of the extended portion 540, there are provided with a plurality of third attachment portions 541 for attaching a plurality of second cables 620 thereto, respectively, with a space provided therebetween. In addition, Along a length of a distal end portion of the extended portion 540, there are provided with a plurality of terminals 542 with a space provided therebetween. The third attachment portions 541 and the terminals 542 are disposed in an alternating manner.

The third attachment portions 541 each are formed by cutting out the extended portion 540 and have a substantially U-shape in cross section. As shown in FIGS. 3 and 5, the third attachment portions 541 each have a substantially I-shaped third support portion 541*a* whose front and rear ends continue to the extended portion 540; and a pair of third sandwiching portions 541*b* provided at opposite ends of the third support portion and bent to be oriented in the same direction as the first and second sandwiching portions 522 and 532 of the first and second attachment portions 520 and 530.

As shown in FIGS. 6, 8A, and 8B, the first cables 610 each are a known coaxial cable having the signal line 611, an inner insulator 612 which covers the signal line 611, a shield conductor 613 which covers the inner insulator 612, and an outer insulator 614 which covers the shield conductor 613.

As shown in FIGS. 6, 8A, and 8B, the second cables 620 each are a known twin cable having two signal lines 621, two inner insulators 622 which respectively cover the two signal lines 621, a shield conductor 623 which covers the two inner insulators 622, and an outer insulator 624 which covers the shield conductor 623.

The steps of assembling the connector C having a configuration as described above will be described below. First, the cable assembly K is assembled.

The outer insulators 614, the shield conductors 613, and the inner insulators 612 at the tip side portions of first end portions of first cables 610 are peeled off to expose the signal lines 611. Thereafter, the outer insulators 614 at the rear side portions of the first end portions of the first cables 610 are peeled off to expose the shield conductors 613. In this condition, the shield conductors 613 of the first cables 610 are placed on the corresponding first or second support portions 521 or 531 of the first or second attachment portions 520 or 530 of the cable attachment 500. Then, the respective pairs of first and second sandwiching portions 522 and 532 are swaged. Consequently, the shield conductors 613 of the first cables 610 are sandwichingly held by the corresponding pairs of first and second sandwiching portions 522 and 532.

The outer insulators 624, the shield conductors 623, and twins of inner insulators 622 at the tip side portions of first end portions of the second cables 620 are peeled off to expose twins of signal lines 621. Thereafter, the outer insulators 624 at the rear side portions of the one end of the second cables 620 are peeled off to expose the shield conductors 623. In this condition, the shield conductors 623 of the second cables 620 are placed on the third support portions 541*a* of the third attachment portions 541 of the cable attachment 500. Then, the respective pairs of third sandwiching portions 541*b* of the third attachment portions 541 are swaged. Consequently, the shield conductors 623 of the second cables 620 are sandwichingly held by the corresponding pairs of the third sandwiching portions 541*b*. These are the steps to assemble the cable assembly K.

Meanwhile, the plurality of contacts 200 and the shield member 300 are insert molded in the body 100. In this step, the contacts 200 are embedded in the upper end portions of the distal end portion 111 of the thick portion 110 and the thin portion 120 of the body 100. Along with this, the first shield portion 310 of the shield member 300 is embedded in the upper end portion of the rear end portion 112 of the thick portion 110, the second shield portion 320 is embedded in the lower end portions of the thick portion 110 and the thin portion 120, the fourth shield portion 340 is embedded in the distal end portion 111 of the thick portion 110, and the pair of fifth shield portions 350 is embedded in the corresponding lower end portions of the overhang portions 130.

At this time, an adjustment is made such that the distance $\alpha$ between the extended portion 342 of the fourth shield portion 340 and the connection end main bodies 222 of the connection ends 220 of the contacts 200 becomes equal to the distance $\beta$ between the ground connection portion 322 of the second shield portion 320 and the contact ends 210 of the contacts 200.

During the above insert molding, the first and second attachment holes 133 and 134 are formed in the overhang portions 130, and first and second connection pieces 351 and 352 of the fifth shield portions 350 are inserted into the corresponding inner portions of the first and second attachment holes 133 and 134 from the bottom.

Thereafter, the signal lines 611 of the first cables 610 and twins of signal lines 621 of the second cables 620 in the cable assembly K are brought into contact with their corresponding connection end main bodies 222 of the connection ends 220 of the contacts 200. Along with this, the terminals 542 of the extended portion 540 of the cable attachment 500 are brought into contact with the corresponding remaining connection end main bodies 222 of the connection ends 220 of the contacts 200. In this condition, the signal lines 611 and 621 and the terminals 542 are solder connected. It should be noted here that the contacts 200 are divided into contacts for signal lines and contacts for grounding. The contacts for signals lines are in contact with the signal lines 611 of the first cables 610 and the signal lines 621 of the second cables 620 and used for connection with the contacts 12 for signal lines of the receptacle connector 10; while the remaining contacts, i.e. The contacts for grounding, are in contact with the terminals 542 and used for connection with the contacts 12 for grounding of the receptacle connector 10.

At this time, the base portion 510 and the extended portion 540 of the cable attachment 500 are placed on the first shield portion 310 of the shield member 300 and come into contact with the first shield portion 310. By this, the cable attachment 500 is electrically connected to the shield member 300. That is, the shield conductors 613 and 623 of the first and second cables 610 and 620 are electrically connected to the first shield portion 310 through the cable attachment 500.

Thereafter, the operating portions 142 of the locking means 140 are pivotally supported by the corresponding turning shaft portions 131*a* of the overhang portions 130, while the operating portions 142 and the urging means are respectively accommodated in the recesses 131 of the overhang portions 130, and the engaging hooks 141 are respectively accommodated in the recesses 131 and the notch portions 151 of the protective arms 150. Consequently, the operating portions 142 are urged by the urging means such that the hook portions of the engaging hooks 141 jut out of the notch portions 151 of the protective arms 150.

Thereafter, the first and second connection arms 421 and 422 of the shield cover 400 are respectively positioned and inserted into the corresponding outer portions of the first and second attachment holes 133 and 134 of the overhang portions 130 from the above, while the turning shaft portions 131*a* of the overhang portions 130 are inserted into the corresponding securing hole portions 423 of the shield cover 400. Consequently, the shield cover 400 is attached to the body 100 with the cable attachment 500 and the first and second cables 610 and 620 of the cable assembly K being sandwiched between the shield cover 400 and the thick portion 110 of the body 100, and the shield cover 400 covers the top sides of the thick portion 110 and the pair of overhang portions 130 of the body 100. By this, the topside and underside of the body 100 except the topside of the thin portion 120 are covered and shielded by the shield member 300 and the shield cover 400.

The steps of connecting the connector C assembled in the above-described manner to the receptacle connector 10 will be described below. First, the thin portion 120 of the body 100 is positioned and inserted into the opening portion 11*a* of the receptacle connector 10. Upon the insertion, the contact ends 210 of the contacts 200 exposed from the topside of the thin portion 120 respectively come into contact with the contacts 12 of the receptacle connector 10, and the ground connection portion 322 of the shield member 300 exposed from the underside of the thin portion 120 comes into contact with the ground portion of the receptacle connector 10.

Along with this, the pair of protective arms 150 of the body 100 is positioned and inserted into the pair of engaging recesses 11*b* of the receptacle connector 10. Consequently, the hook portions of the engaging hooks 141 of the pair of locking means 140 jutting out of the notch portions 151 of the pair of protective arms 150 are respectively locked in the pair of engaging recesses 11*b* by the urging forces of the urging means of the locking means 140.

When detaching the connector C from the receptacle connector 10, the third apex portions of the operating portions 142 are operated against the urging forces of the urging means and thereby the hook portions of the engaging hooks 141 are accommodated in the corresponding notch portions 151 of the protective arms 150. Consequently, the engagement of the hook portions of the engaging hooks 141 in the engaging recesses 11*b* is released, whereby the thin portion 120 of the body 100 can be pulled out of the opening portion 11*a* of the receptacle connector 10 and the pair of protective arms 150 of the body 100 can also be pulled out of the pair of engaging recesses 11*b* of the receptacle connector 10.

In the connector C as described above, the first shield portion 310 of the shield member 300 is embedded in the upper end portion of the rear end portion 112 of the thick portion 110 of the body 100, the second shield portion 320 is embedded in the lower end portions of the thick portion 110 and the thin portion 120, the fourth shield portion 340 is embedded in the distal end portion 111 of the thick portion 110, and the pair of fifth shield portions 350 is embedded in the lower ends of the overhang portions 130. Such configuration can improve the strength of the body 100, making it possible to slim down the body 100.

Moreover, when embedding the contacts 200 and the shield member 300 in the body 100 by insert molding, an adjustment can be made such that the distance α between the connection end main bodies 222 of the connection ends 220 of the contacts 200 and the extended portion 342 of the fourth shield portion 340 becomes equal to the distance β between the contact ends 210 of the contacts 200 and the ground connection portion 322 of the second shield portion 320. Such adjustment makes it possible to control impedances of the two regions α and β for impedance matching, resulting in improved transmission characteristics. As a result, the connector can be used for high-speed digital signal transmission.

It should be noted that the form of the body 100 is not limited to the one in the above-described embodiment; as long as the body 100 is an elongated body allowing to arrange contacts in a spaced relation thereon along its length direction with a space provided therebetween, any design changes can be made to the form of the body 100.

As long as the contacts 200 are arranged in spaced relation along a length of the body, any design changes can be made to the forms of the contacts 200.

Any design changes can be made to the shield member 300 as long as it has a first shield portion for shielding first thicknesswise end portion of the body and a second shield portion for shielding the second thicknesswise end of the body and at least one of the first and second shield portions is partly or entirely embedded in the body.

As an example of embedding a part or all of at least one of the first and second shield portions in the body, the following configuration can be adopted: the first shield portion 310 is bent such that its distal end is embedded toward the distal end of the rear end portion 112 of the thick portion 110 while its rear end is placed on a surface toward the rear end of the rear end portion 112. Alternatively, only the bottom plate portion 321 of the second shield portion 320 may be embedded in a lower end portion of the thick portion 110, or only the ground connection portion 322 of the second shield portion 320 may be embedded in a lower end portion of the thin portion 120.

Any design changes can be made to the first and second shield portions 310 and 320 as long as they can shield the first and second thicknesswise ends of the body, respectively.

The ground connection portion 322, instead of being embedded in a lower end portion of the thin portion 120, can be arranged along the lower end portion. Even if the design is thus changed, the ground connection portion 322 can still function as a ground connection portion. It is also possible to embed the ground connection portion 322 inside the lower end portion of the thin portion 120 to make the ground connection portion 322 simply serve as a shield portion.

It is preferable to provide the third shield portion 330 if the second shield portion 320 has the ground connection portion 322. This is because by the ground connection portion 322 coming into contact with the ground portion of the receptacle connector 10, the entire shield member 300 is ground connected. Note that the form of the third shield portion 330 is not limited to the one described in the above-described embodiment.

The fourth shield portion 340 can have any form as long as the form allows the distance α between the fourth shield portion 340 and the connection end main bodies 222 of the connection ends 220 of the contacts 200 to be the same as the distance β between the contact ends 210 of the contacts 200 and the ground connection portion 322 of the second shield portion 320. Of course, it is also possible to provide the fourth shield portion 340 separately, which may be embedded inside the distal end portion 111 of the thick portion 110 to be brought into contact with the second shield portion 320, etc. Alternatively, the fourth shield portion 340 may be omitted and supplanted by a part of the bottom plate portion 321 of the second shield portion 320 that is bent and inside the distal end portion 111 of the thick portion 110.

Although it is described above that the fifth shield portions 350 each have the first and second connection pieces 351 and 352, at least one of the first and second connection pieces 351 and 352 should be provided. The first and second connection pieces 351 and 352 may have any forms as long as they can be inserted into corresponding attachment holes of the body.

It is optional to provide the shield cover 400. Any design changes may be made to the form of the shield cover 400.

Although it is described above that the shield cover 400 has the first and second connection arms 421 and 422, at least one of the first and second connection arms 421 and 422 should be provided. The first and second connection arms 421 and 422 may have any forms as long as they can be inserted into corresponding attachment holes of the body.

The first and second locking projections 421*a* and 422*a* can also be provided to the first and second connection pieces 351 and 352. Alternatively, the first and second locking projections 421*a* and 422*a* can be changed to any other locking means and should be provided to at least one of a connection piece of the shield member and a connection arm of a shield cover.

Although it is described above that the connector C includes the cable assembly C, the connector C should include at least one type of cables to be connected to contacts.

The cables are not limited to the aforementioned coaxial cables and twin cables; needless to say, other kinds of cables such as single-core cables can also be used.

Although it is described above that the connector C is a plug connector, the connector C is not limited thereto; the connector C can be a receptacle connector.

What is claimed is:

1. A connector comprising:

an elongated body having a plurality of contacts arranged in spaced relation along a length thereof; and a shield member for shielding the body, wherein the shield member includes a first shield portion insert molded and embedded in a first thicknesswise end of the body for shielding the first thicknesswise end of the body; and a second shield portion insert molded and embedded in a second thicknesswise end of the body for shielding the second thicknesswise end of the body, and a third shield portion connecting the first and second shield portions.

2. A plug connector that is connectable to a receptacle connector, the plug connector comprising:

an elongated body having a plurality of contacts arranged in spaced elation along a length thereof;

a shield member for shielding the body; and a plurality of cables connectable to the corresponding contacts, respectively, wherein the shield member includes a first shield portion for shielding a first thicknesswise end of the body;

a second shield portion for shielding a second thicknesswise end of the body; and a third shield portion connecting the first and second shield portions, at least one of the first and second shield portions is partly or entirely embedded in the body by insert molded into the body, the contacts each include:

a contact end which is exposed from a first thicknesswise end face of a widthwise distal end portion of the body and which is contactable to a contact of the receptacle connector; and a connection end which is exposed from a first thicknesswise end face of a middle widthwise portion of the body and to which a corresponding one of the cables is connected, the second shield portion has a ground connection portion that is disposed along the contact ends and is connectable to a ground portion of the receptacle connector.

3. The connector according to claim 2, wherein the second shield portion is embedded in the second thicknesswise end portion of the body such that the ground connection portion thereof is exposed from a second thicknesswise end face of the distal end of the body.

4. The connector according to claim 2, wherein the body includes:

a thick portion; and a thin portion which is provided to the thick portion and which is fittable into the receptacle connector, the thin portion is provided with the contact ends and the tick portion is provided with the connection ends, the shield member further includes a fourth shield portion which continues to the first shield portion and which is embedded in the thick portion so as to be oriented along the connection ends, and a distance between the fourth shield portion and the connection ends is substantially the same as a distance between the ground connection portion of the second shield portion and the contact ends.

5. The connector according to claim 2, further comprising:

a shield cover which is attachable to the body with the cables being sandwiched between the shield cover and the body and which covers the first thicknesswise end fact of the body, wherein lengthwise opposite end portions of the body are provided with a pair of attachment holes for attaching the shield cover therethrough, lengthwise opposite end portions of the second shield portion are provided with at least a pair of connection pieces, the connection pieces are respectively insertable into the pair of attachment holes from a second thicknesswise end side, and lengthwise opposite end portions of the shield cover are provided with at least a pair of connection arms, the connection aims being respectively insertable into the pair of attachment holes from a first thicknesswise end side and respectively coming into contact with the pair of connection pieces.

6. The connector according to claim 5, wherein, of the pair of the connection pieces and the pair of the connection arms, at least one pair serves as means for locking the other pair.

7. The connector according to claim 2, wherein the cables each include:

a signal line;

an insulator covering the signal line; and a shield conductor provided on a peripheral surface of the insulator, the first shield portion shields a widthwise rear end of the body and are in contact with the shield conductors of the cables in a state that the signal lines of the cables are connected to the corresponding connection ends of the contacts.

8. The connector according to claim 3, wherein the cables each include:

a signal line;

an insulator covering the signal line; and a shield conductor provided on a peripheral surface of the insulator, the first shield portion shields a widthwise rear end of the body and are in contact with the shield conductors of the cables in a state that the signal lines of the cables are connected to the corresponding connection ends of the contacts.

9. The-connector according to claim 3, wherein the body includes:

a thick portion; and a thin portion which is provided to the thick portion and which is fittable into the receptacle connector, the thin portion is provided with the contact ends and the thick portion is provided with the connection ends, the shield member further includes a fourth shield portion which continues to the first shield portion and which is embedded in the thick portion so as to be oriented along the connection ends, and a distance between the fourth shield portion and the connection ends is substantially the same as a distance between the ground connection portion of the second shield portion and the contact ends.

* * * * *